US005980850A

United States Patent [19]

Lebl

[11] Patent Number: 5,980,850

[45] Date of Patent: Nov. 9, 1999

[54] PROCESS AND PLANT FOR EXTRACTION OR RECOVERY OF ACIDS FROM SOLUTIONS OF THESE ACIDS

[75] Inventor: Albert Lebl, Vienna, Austria

[73] Assignee: Andritz-Patentverwaltungs-Gesellschaft m.b.H., Graz, Austria

[21] Appl. No.: 08/752,558

[22] Filed: Nov. 21, 1996

[30] Foreign Application Priority Data

Nov. 27, 1995 [AT] Austria ..... A 1931/95

[51] Int. Cl.[6] ..... C01B 7/03; C01B 7/19; C01B 21/38

[52] U.S. Cl. ..... 423/394.2; 423/488; 423/484; 423/DIG. 1

[58] Field of Search ..... 423/484, 488, 423/394.2, DIG. 1, 632, 633

[56] References Cited

U.S. PATENT DOCUMENTS

| | | | |
|---|---|---|---|
| 3,399,964 | 9/1968 | Michels et al. | 423/488 |
| 3,529,931 | 9/1970 | Moklebust | 423/DIG. 1 |
| 3,578,401 | 5/1971 | Ueberle et al. | 423/488 |
| 3,658,483 | 4/1972 | Lienau et al. | 423/DIG. 1 |
| 3,669,623 | 6/1972 | Allison et al. | 423/488 |
| 3,851,047 | 11/1974 | Bailey | 423/DIG. 1 |

FOREIGN PATENT DOCUMENTS

| | | | |
|---|---|---|---|
| 43 15 551 | 11/1994 | Germany | 423/484 |

OTHER PUBLICATIONS

Olsen, "Unit Processes and Principles of Chemical Engineering" pp. 1–3, Jul. 1932.

Translation of DE 4315551 (Nov. 1994).

Conners, "Hydrochloric Acid Regeneration as Applied to The Steel & Mineral Processing Industries", CIM Bulletin, pp. 75–91, Feb. 1975.

*Primary Examiner*—Ngoc-Yen Nguyen
*Attorney, Agent, or Firm*—Alix, Yale & Ristas, LLP

[57] ABSTRACT

Process for extraction or recovery of acids, in particular hydrofluoric acid, hydrochloric acid and nitric acid, from solutions of these acids containing metal, by pyrohydrolytic treatment and subsequent absorption and/or condensation of the acid gases thus formed in an aqueous absorption solution, in which process the solids produced are removed. In order to guarantee economical acid recovery in existing plants without requiring large-scale adaptation, the waste pickling liquor is subjected to pre-concentration first of all before pyrohydrolysis, using the heat contained in the exhaust gas from the pyrohydrolysis. In a device for extraction or recovery of acids in particular hydrofluoric acid, hydrochloric acid and nitric acid, from solutions of these acids containing metal, comprising a feed pipe for the solution, a pyrohydrolysis reactor, and at least one absorption or condensation column connected to the exhaust gas pipe from the reactor, a device is provided for pre-concentration and upgrading of the solution.

3 Claims, 2 Drawing Sheets

PROCESS AND PLANT FOR EXTRACTION OR RECOVERY OF ACIDS FROM SOLUTIONS OF THESE ACIDS

BACKGROUND OF THE INVENTION

The invention refers to a process for extraction or recovery of acids, in particular hydrofluoric acid, hydrochloric acid and nitric acid, from solutions of these acids containing metal, by pyrohydrolytic treatment, separation of the metals and subsequent absorption and/or condensation of the thus formed acid gases in an aqueous absorption solution.

Solutions of hydrofluoric, hydrochloric or nitric acid containing metal are produced in the metal industry, for example, in the form of mixed acid waste pickle liquor from the surface treatment of standard steel grades, stainless steels, special alloys and special metals. These solutions contain free acids, such as hydrofluoric acid, hydrochloric acid and nitric acid, as well as dissolved metals, such as iron, chrome and nickel, in the form of fluorides, nitrides and chlorides and they have to be renewed as from a metal concentration of approximately 35–120 g/l, depending on their application. A number of methods have already been developed to recover the hydrofluoric acid, hydrochloric acid and nitric acid from the used solutions for recycling back to the pickling process and, to a large extent, these methods also avoid the problems of disposal which arise due to environmental regulations and the ever increasing disposal costs. The methods already known for recovery of hydrofluoric acid, hydrochloric acid and nitric acid are, for example, solvent extraction, dialysis and the use of ion exchangers.

In AT-PS 395.312, the author also suggested releasing these acids from solutions containing metals by means of the pyrohydrolytic stage of the spray roasting and then either absorbing and/or condensing the gases produced. It is preferred to conduct absorption and/or condensation in two columns, in which process the amount of hydrofluoric acid, hydrochloric acid or nitric acid extracted can be improved by controlling the column temperature.

Low temperatures (<50° C.) are particularly important for recovery of nitric acid from $NO_x$. In this process, however, the acid regenerated is diluted because of the water condensation from the exhaust gas, so large amounts of fresh acid have to be added in order to reach the concentration required for use in the pickling process. The continuous increase in volume also creates the need to discard a part of the waste pickle liquor or the regenerate or to neutralize it. Even if the regenerated acid is split into a portion rich in hydrofluors and a more dilute acid portion, there is less need to acidify further, however the dilute acid is not always required and part of it has to be discarded or neutralized.

In addition, the amount of nitric acid extracted drops automatically if the hydrofluor concentration in the regenerate is increased by splitting into acids with a high concentration of hydrofluors and a low concentration of hydrofluors, although the concentrated, regenerated acid only contains the condensable $HNO_3$ portion and has to be further acidified by adding nitric acid, which again causes dilution.

The energy consumption for this has also been high to date because, on the one hand, the waste pickle liquor has to be evaporated during spray roasting in order to be regenerated and on the other hand, the flow of exhaust gas after the Venturi washer has to be condensed again.

SUMMARY OF THE INVENTION

The object of the invention is, therefore, to find a process in which the above mentioned disadvantages can be avoided and which also guarantees economical acid recovery in existing plants without requiring large-scale adaptation. A further object was to develop a plant to carry out the process.

According to the invention, the waste pickle liquor is pre-concentrated before pyrohydrolysis in order to perform this task. This pre-concentration, which serves at the same time to boost the concentration of the waste pickle liquor, helps achieve a higher concentration of the acids in the regenerate after the subsequent pyrohydrolytic process and after absorption or condensation, thus avoiding the expense of acid neutralization due to an excessive increase in volume. At the same time, 10 to 20% of gas consumption is saved, as is fresh acid for acidification. There are also fewer problems with deposits in the pyrohydrolysis reactor, regardless of the reactor design used.

Due to the low initial quantities for pyrohydrolytic treatment, new plants can be equipped with smaller reactors and subsequent plant components, for example, Venturis or absorption/condensation columns, to handle the same quantities of waste pickling liquor, thus making these plants more economical.

If, advantageously, pre-concentration is conducted from 5 to 30%, preferably from 10 to 20%, the regenerate can reach a concentration that no longer requires splitting the acids into separate streams.

According to a further feature of the invention, the waste pickle liquor for pre-concentration is heated by heat exchanging using the medium from at least one, preferably the first absorption or condensation column, after which process this medium is returned to the column. By doing so, the exhaust gas from the pyrohydrolysis reactor is cooled and condensed on the one hand and on the other, the heat thus obtained is used to heat and concentrate the waste pickle liquor. At the same time, cooling water can be saved in the column itself.

It is of advantage if part of the cooled medium from the absorption or condensation columns is removed as first regenerate directly after the heat exchanging process and then recycled into the process if required. Thus, the regenerate is available immediately and in a cooled state in a simple way.

The second objective is fulfilled by a device for extraction or recovery of acids, in particular hydrofluoric acid, hydrochloric acid and nitric acid, from solutions of these acids containing metals, comprising a feed pipe for the solution, a pyrohydrolysis reactor, and at least one absorption or condensation column with a connection to the exhaust gas pipe of the reactor, and which is characterized by a device being provided for pre-concentrating and upgrading the solution. In this way, all of the advantages mentioned in the preceding paragraphs can be realized in a simple plant design, which can be adapted easily and inexpensively to the process according to the invention, even in existing plants.

In particularly simple structural designs, the device for pre-concentrating and upgrading is a heat exchanger.

According to a further feature of the invention, the heat exchanger is connected to the circulating system of at least one, preferably the first absorption or condensation column. In this way, the heat content of the medium of this column can be used to heat the solution and the medium can be cooled right away to the desired temperature in the column, thus saving cooling water.

As an alternative, the heat exchanger can be connected to the circulating system of a condenser in the reactor exhaust gas pipe.

It is an advantage if drainage pipes are provided in flow direction for the cooled medium downstream of the heat exchanger.

BRIEF DESCRIPTION OF THE DRAWINGS

In the following description, the invention will be explained in more detail on the basis of non-restrictive design examples, with reference to the enclosed illustrations.

DETAILED DESCRIPTION OF THE PREFERRED EMBODIMENT

Figure 1:
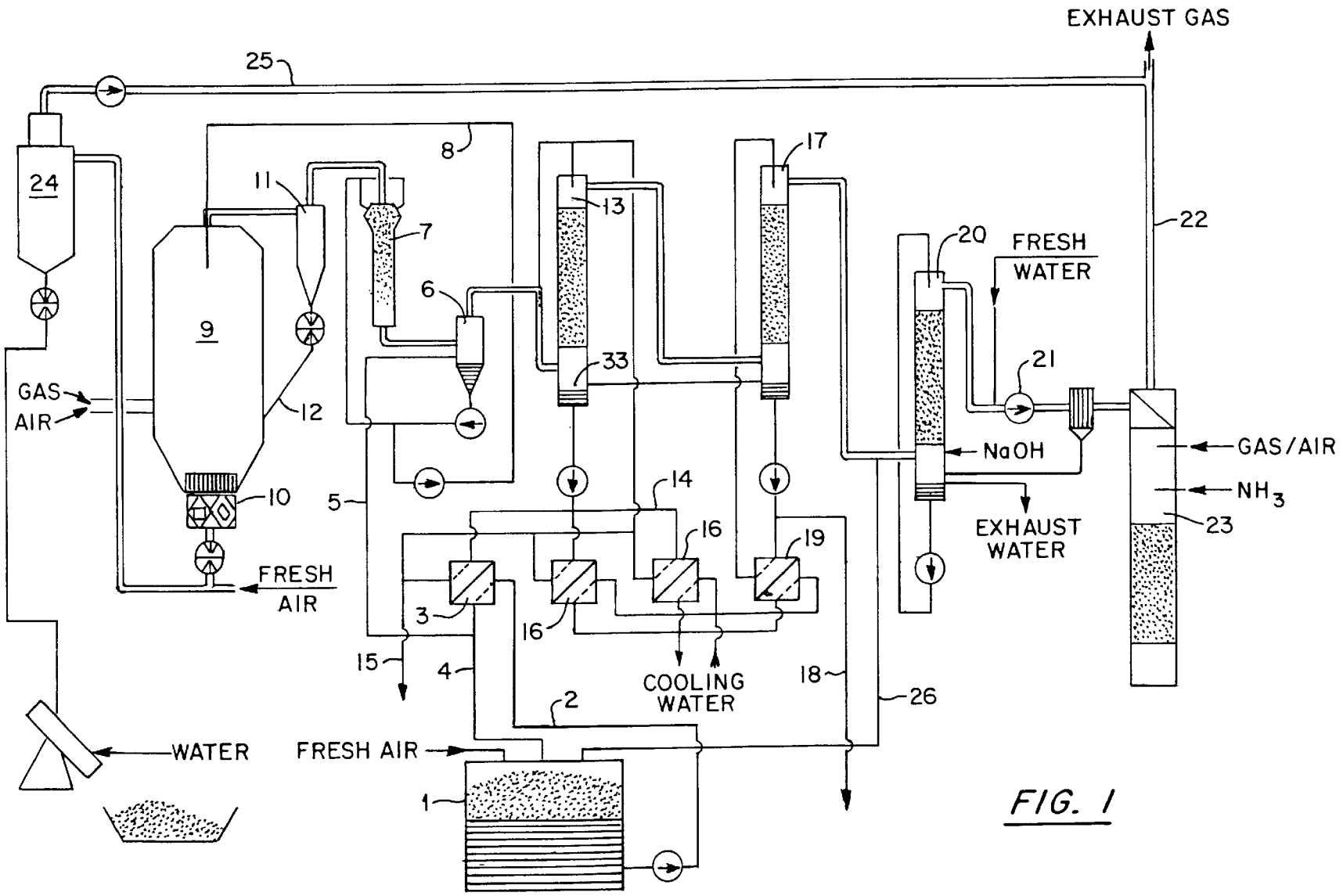
FIG. 1 shows a pickling acid regenerating plant with storage tank, spray roasting reactor and two absorption columns for the spray roast exhaust air, as well as a heat exchanger for pre-concentrating the waste pickling liquor.

In the design shown in FIG. 1, the used waste pickling liquor containing the free acids (hydrofluoric acid or hydrochloric acid or nitric acid) and the dissolved metals leaves an intermediate storage tank 1 through a pipe 2 leading to a heat exchanger 3, where the waste pickling liquor is heated by heat exchanging with a hot medium. The concentrate is fed through pipe 4 back to the storage tank 1 and sprayed into it, during which process part of the liquid evaporates due to the heating process, the large surface area and the air permeating it. This liquid is pre-evaporated to preferably 10 to 25% and thus, also pre-concentrated while most of the acids and metallic salts remain in the concentrate. Another part of the heated waste pickling acid is fed through a pipe 5 to a separator 6.

The concentrate from the separator 6 is divided again into two portions, one of which is used in the jet washer 7 for cleaning the exhaust air from the pyrohydrolysis and the other part is fed through pipe 8 to the spray roasting reactor 9 for pyrohydrolytic transformation of the metallic salts into free acids and metal oxides. The metal oxides are discharged from the base of the reactor 9 through conventional devices 10, in the same way as the dust portion carried along out of the reactor 9 is separated in the cyclone 11 and returned to the reactor 9 through a pipe 12.

After going through the cyclone 11, the jet washer 7 and the separator 6, the spray roasting exhaust gases from the reactor 9 are fed to a condensation stage 33 of an absorption and condensation column 13.

At least a portion of the medium in the first condensation stage 33 is circulated through the heat exchanger 3 in order to heat the waste pickling liquor for pre-concentrating. Part of the cooled medium from the heat exchanger 3 is drained off through pipe 15 as first regenerate and is available for re-use as pickling solution. The remainder is returned to the condensation column 13.

Only part of the medium taken from the condenser 33 is, however, fed through the heat exchanger 3. The other part is fed via pipe 14 through at least one, preferably through two heat exchangers 16 fed with cooling water in order to cool the medium sufficiently, which is very hot due to the strongly exothermic reactions in column 13.

From the first absorption and condensation column 13 the exhaust gas from the spray roasting reactor 9 goes onto a further absorption or condensation column 17, where the medium is also fed through a loop and here part of it also overflows into column 13 as regenerate and on to the heat exchanger 3, from where it is drained off through a pipe 15 and then becomes available for re-use in the pickling plant. The regenerate from column 17 is cooled in a heat exchanger 19 and recirculated. Part of the regenerate is fed directly back to the pickling plant via pipe 18.

At the end of the process, the exhaust gas from column 17 is also fed to an alkaline gas scrubber 20 and is finally discharged into the open air by the exhaust air fan 21, which has already provided the necessary underpressure required to transport the gas through the plant. The exhaust gas exits from the plant through the exhaust air chimney 22. If necessary, a $DeNO_x$ plant 23 can also be included to perform catalytic reduction of $NO_x$ with ammonia or urea.

As an additional item, a separator plant 24 for gases which have escaped from the reactor 9 together with the solids can be provided on the discharge side of the reactor 9. The exhaust gas pipe 25 from the separator also leads to the exhaust gas chimney 22 and the solids are discharged from the base of the plant 24.

The part of the initial solution which evaporates in the storage tank 1 is fed through a pipe 26 to the alkaline gas scrubber 20 in order to remove the traces of acid in it before it is discharged into the environment.

Figure 2:
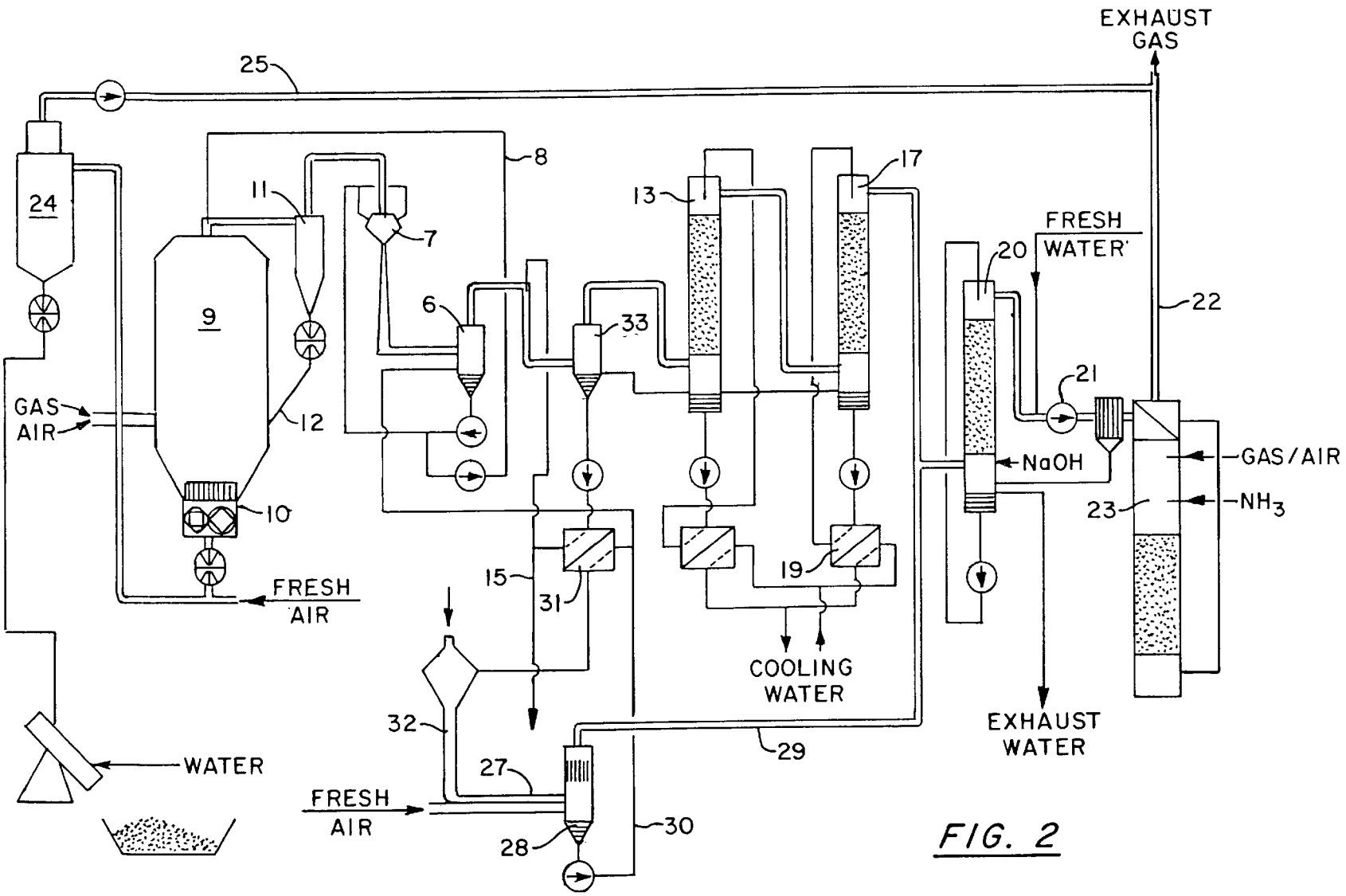
FIG. 2 shows an alternate embodiment of the plant without a storage tank.

In the somewhat different design of the plant shown in FIG. 2—where the same plant components as in FIG. 1 are depicted with the same reference numbers—the waste pickling liquor is fed as starting solution through a pipe 27 to an evaporator 28. The gas outlet 29 from this evaporator is connected to the alkaline gas scrubber 20. Part of the waste pickling liquor added is fed from the liquid sump of the evaporator 28 through a pipe 30 to the first separator 6 of the spray roasting absorption or condensing plant. As already described, part of this liquor is sprayed into the reactor 9 and the other part is used in the jet washer 7 for cleaning exhaust gas.

The remainder of the waste pickling liquor from the evaporator 28 is fed to a heat exchanger 31, in which it is heated in such a way that the water contained in the waste pickling liquor can evaporate when it is then sprayed into the fresh air supply 32 to the evaporator 28 and can be fed to the alkaline washer 20 through the gas outlet 29.

Downstream of the first separator 6 already described, a condenser 33 separate from column 13 is provided, with its condensate outlet leading into the heat exchanger 31. The hot condensate from the condenser 33 heats the waste pickling liquor from the evaporator 28 in the heat exchanger 31 and is cooled there itself. Some of this condensate can be removed from the process in the form of regenerate downstream of the heat exchanger 31 and the remainder sprayed into the exhaust gas pipe upstream of the condenser 33.

Downstream of the condenser 33, the pre-cleaned air from the spray roasting reactor 9 enters a first absorption or condensing column 13, a second absorption or condensing column 17 and finally, after the alkaline gas scrubber 20 and the $DeNO_x$ plant 23, if included, it leaves the plant through the exhaust gas chimney 22 and is discharged into the open air.

The liquid sumps of columns 13 and 17 drain into the liquid sump of the condenser 33, from where this liquid enriched with the acids is taken together with the condensate from the reactor exhaust gas through the heat exchanger 31 to form regenerate that can be re-used for the pickling process.

The invention will be explained in more detail below on the basis of two design examples.

DESIGN EXAMPLE 1

A solution containing hydrochloric acid with the following composition was treated in the pilot plant, whose design is basically the same as shown in FIG. 2:

| | |
|---|---|
| Fe | 34.1 g/l |
| Mg | 14.5 g/l |
| Al | 6.8 g/l |
| Cl | 180.5 g/l |

This solution was fed to the pre-evaporator (28) at a rate of 26 l/hr. Fresh air at a temperature of 31° C. was sucked into this pre-evaporator with the aid of the exhaust gas fan. The temperature of the exhaust gas after the evaporator was 62° C. The evaporator was heated indirectly using regenerated acid draining off with an inlet temperature of 72° C. and an exit temperature of 62° C. The quantity of pre-concentrated solution produced was 22.6 l/hr, i.e. concentration amounted to $$\frac{26-22.6}{26}=13\%$$

The chloride content was 207.5 g/l, i.e. upgrading amounted to $$\frac{207.5-180.5}{180.5}=14.9\%$$

The entire quantity of this pre-concentrated solution was fed to the Venturi storage tank (6) and sprayed into the reactor (9) from there after being further upgraded. The amount fed to the reactor amounted to 16.5 l/h.

DESIGN EXAMPLE 2

A synthetic waste pickling liquor from stainless steel pickle with the following composition was treated in the pilot plant (as in Example 1):

| | |
|---|---|
| Fe | 35 g/l |
| Cr | 7 g/l |
| Ni | 6 g/l |
| F | 45 g/l |
| $HNO_3$ | 118 g/l |

This solution was fed to the pre-evaporator (28) at a rate of 20 l/hr. Fresh air at a temperature of 28° C. was sucked into this pre-evaporator. The temperature of the exhaust gas after the evaporator was 58° C. The evaporator was heated indirectly using regenerated acid draining off with an inlet temperature of 67° C. The quantity of pre-concentrated solution produced was 17.9 l/hr, i.e. concentration amounted to $$\frac{20-17.9}{20}=10.5\%$$

The fluoride content was 50 g/l, i.e. upgrading amounted to $$\frac{50-45}{45}=11.1\%$$

The pre-concentrated solution was fed to the Venturi storage tank (6) and from there to the reactor (9), as described above.

What is claimed is:

1. Process for extraction or recovery of hydrofluoric acid, hydrochloric acid, nitric acid, or a mixture of these acids from waste pickling liquor containing these acids and metal, in a recovery system having a pre-concentrator unit comprising at least one heat exchanger, a reactor and at least one absorption and condensation column, the process comprising the steps of:

a. heating a portion of the waste pickling liquor with the recovered acid solution from the at least one absorption and condensation column of step h by indirect heat exchange using the at least one heat exchanger of the pre-concentrator unit to form a heated waste pickling liquor and a cooled recovered acid solution;

b. spraying a portion of the heated waste pickling liquor into the remainder of the waste pickling liquor while permeating air to evaporate water from the waste pickling liquor and removing the water from the recovery system;

c. feeding the remainder of the heated waste pickling liquor to a separator;

d. washing the acid vapors obtained from the reactor of step f with a portion of the waste pickling liquor discharged from the separator to form a concentrated waste pickling liquor;

e. returning the concentrated waste pickling liquor from step d to the separator;

f. performing, in the reactor, pyrohydrolytic treatment on the remainder of the waste pickling liquor discharged from the separator, to form acid vapors and metal oxides;

g. discharging the metal oxides; and h. absorbing or condensing the acid vapors after the washing step in an aqueous solution in the at least one absorption and condensation column to form a recovered acid solution.

2. Process according to claim 1, further comprising the step of returning at least a portion of the cooled recovered acid solution to the absorption and condensation column.

3. Process according to claim 1, wherein the recovery system has first and second absorption and condensation columns, the process further comprising the step of returning two regenerates from the recovery system to a pickling plant, a portion of the acid solution recovered after passing through the first absorption and condensation column and heat exchanger as a first regenerate with higher HF (hydrofluoric acid) concentration and a second regenerate recovered after passing through the second absorption and condensation column having a higher $HNO_3$ (nitric acid) concentration.

* * * * *

UNITED STATES PATENT AND TRADEMARK OFFICE

CERTIFICATE OF CORRECTION

PATENT NO. : 5,980,850

DATED : November 9, 1999

INVENTOR(S) : Lebl

It is certified that error appears in the above-indentified patent and that said Letters Patent is hereby corrected as shown below:

Claim 3, column 6, line 52, delete "a portion of".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*